United States Patent [19]

Tack et al.

[11] 3,997,202

[45] Dec. 14, 1976

[54] DOOR LOCK FOR AUTOMOTIVE VEHICLE

[75] Inventors: Albert Tack; Friedrich Gabel, both of Wuppertal-Ronsdorf, Germany

[73] Assignee: Firma Tack & Gabel, Wuppertal-Ronsdorf, Germany

[22] Filed: Oct. 15, 1974

[21] Appl. No.: 514,894

Related U.S. Application Data

[63] Continuation of Ser. No. 330,488, Feb. 8, 1973, abandoned.

[30] Foreign Application Priority Data

Feb. 8, 1972 Germany ..... 7204613

[52] U.S. Cl. ..... 292/216; 292/DIG. 41

[51] Int. Cl.[2] ..... E05C 3/26

[58] Field of Search ... 292/216, 280, 198, DIG. 24, 292/DIG. 26, DIG. 41

[56] References Cited

UNITED STATES PATENTS 3,281,176 10/1966 McKey ..... 292/216

*Primary Examiner*—Richard E. Moore

*Attorney, Agent, or Firm*—Ernest G. Montague; Karl F. Ross; Herbert Dubno

[57] ABSTRACT

A door-lock assembly for an automotive vehicle comprises a locking wedge on a post of the vehicular frame which upon closure of the door slides into a keeper on the outer door surface, this wedge being engageable by a pivoted catch in the keeper under the control of a latch mechanism within the door. Vertical play between the wedge and a guide channel of the keeper is equalized by a central wedge body of plastic material bearing elastically upon opposite edges of the channel through a pair of metallic yokes or by resilient tongues integral with that body.

8 Claims, 17 Drawing Figures

Fig.3
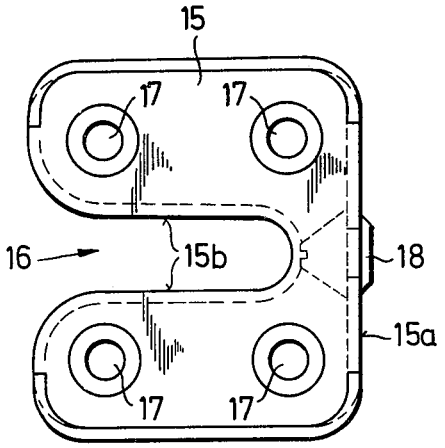
Fig.4
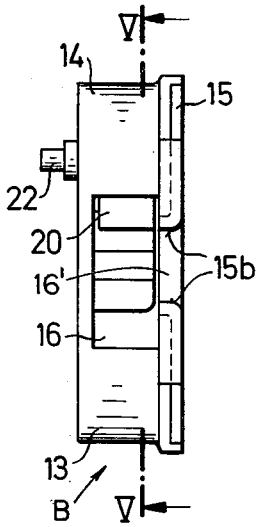
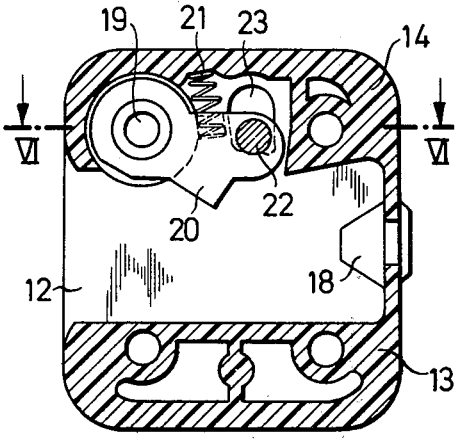
Fig.5
Fig.6
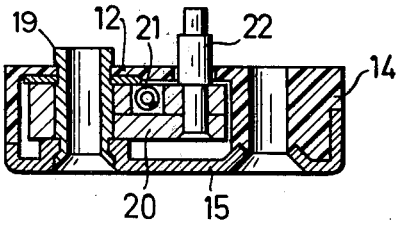

Fig.9
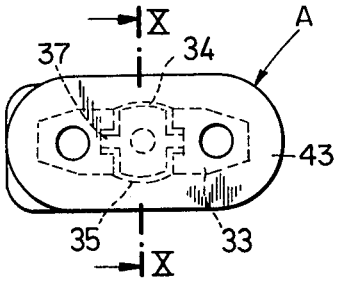
Fig.10
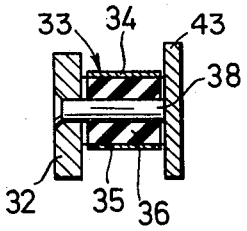
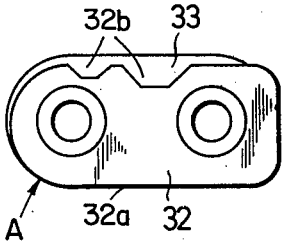
Fig.11
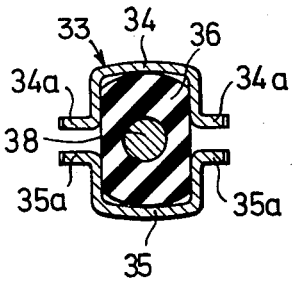
Fig.12

Fig.13
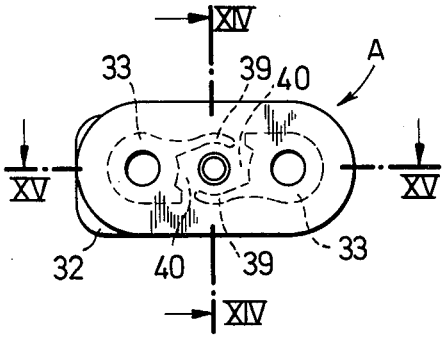
Fig.14
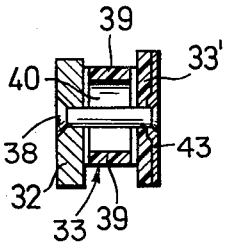
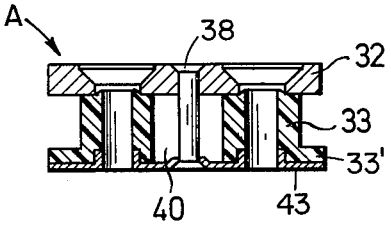
Fig.15
Fig.17
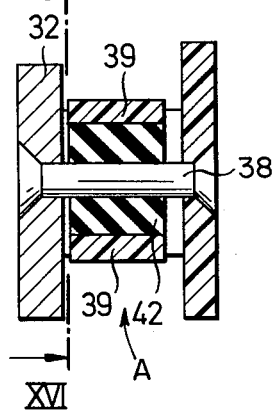
Fig.16
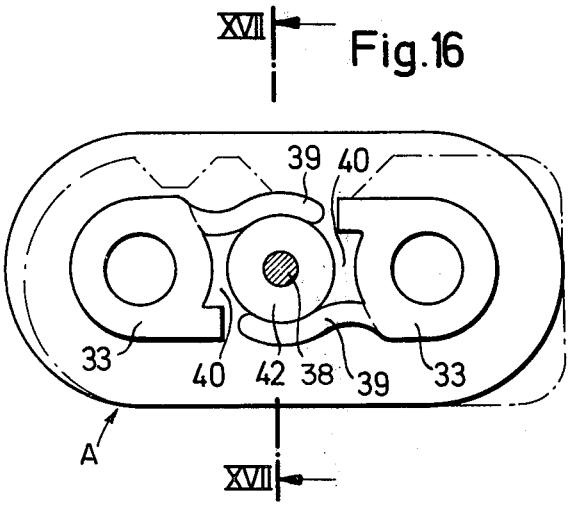

DOOR LOCK FOR AUTOMOTIVE VEHICLE

This is a continuation of application Ser. No. 330,488, filed Feb. 8, 1973, now abandoned.

The present invention relates to a door lock, installed in an automotive vehicle, whose principal parts are located in a latch housing on the inside of the door and are coupled with a spring-loaded catch projecting into the door joint between the sheet-metal facing of the door and a beam or post of the vehicle frame to coact with a locking wedge on the beam.

In order to provide a versatile lock assembly adapted to be fitted with only minor changes to various types of automotive vehicles, it is advantageous to accommodate the catch in a keeper which is fixedly secured to the outer door surface confronting the door post and has a horizontally extending pocket designed to receive the wedge upon closure of the door, the catch being linked with the lock mechanism in the latch housing through a pin traversing a slot in the door paneling. The pocket is open at an insertion end and registers with an elongate guide channel in the exposed sidewall of the keeper.

The general object of our present invention is to provide means in such a lock assembly for maintaining a close fit — even after prolonged use — between the wedge and the keeper in order to facilitate proper operation of the catch and to prevent annoying rattling when the vehicle is in motion.

A more particular object is to provide an improved construction of the locking wedge insuring such a fit by equalizing the play normally existing between the wedge and the vertical edges of the guide channel.

We realize these objects, in accordance with our present invention, by providing the locking wedge with a central body portion of plastic material bearing elastically upon opposite parallel boundaries of the guide channel, this body portion being sandwiched between two plates of greater height. One of the plates, having an indented edge engageable by the preferably pivoted catch, is received in the pocket while the other plate remains outside adjacent the channeled keeper wall.

The elastic body portion may be a buffer centered on a connecting bolt between the two plates and bracketed between a lower and an upper metallic yoke contacting the corresponding channel edges. It could also be constituted by a pair of resilient tongues integral with the resilient plastic body; these tongues, in turn, may be supported by a central buffer carried on the aforementioned connecting bolt.

These and other features of our invention will become apparent in the following detailed description given in connection with the accompanying drawing in which:

FIG. 3 is a side view of the keeper;

FIG. 4 is an end view thereof showing the insertion end of a pocket accommodating the locking wedge;

FIG. 5 is a section along the line V—V of FIG. 4;

FIG. 6 is a further section along the line VI—VI of FIG. 5;

FIG. 9 is an elevation of a locking wedge equipped with double-acting play-equalization means;

FIG. 10 is a section along the line X—X of FIG. 9;

FIG. 11 is an elevational view of the locking wedge as seen from the lock side;

FIG. 12 shows the play-equalization means of FIGS. 9 and 10 drawn to an enlarged scale;

FIG. 13 is a view similar to FIG. 9, showing a locking wedge with alternate play-equalization means;

FIG. 14 is a section along the line XIV—XIV of FIG. 13;

FIG. 15 is a section along the line XV—XV of FIG. 13;

FIG. 16 is an elevational view, drawn to a larger scale, of a locking wedge similar to that of FIG. 13 but with modified play-equalization means; and FIG. 17 is a section along the line XVII—XVII of FIG. 16

Figure 1:
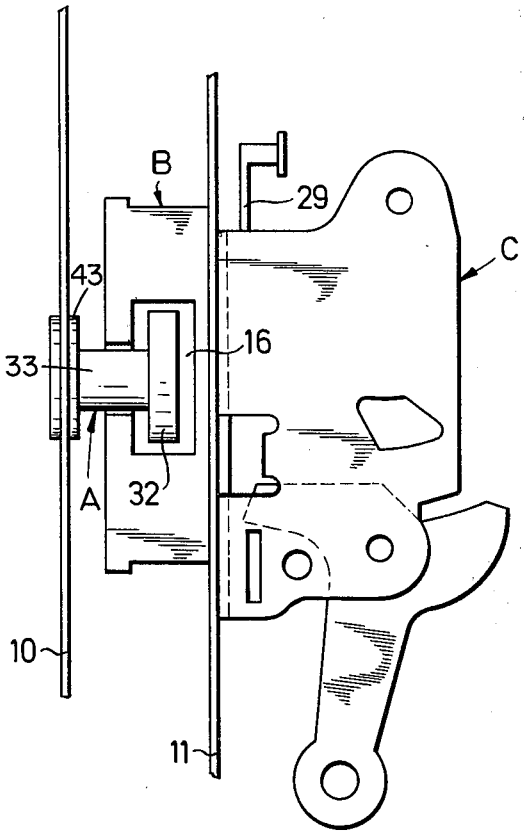
FIG. 1 is a schematic elevation of a door lock designed in accordance with the present invention, with a locking wedge inserted into an associated keeper.

The lock assembly shown in FIG. 1 comprises a locking wedge A secured to a sheet-metal facing 10 on a door post of a vehicle whose door carries a keeper B on the outside and a lock housing C on the inside of a panel 11. The keeper B (see FIGS. 3 – 8) has a body of synthetic material with a solid sidewall 12 and lower and upper cheeks 13 and 14 spaced apart from each other, the opposite side of this body being partly closed by a cover 15 having a horizontal guide channel 16' giving access to a wedge-receiving pocket 16 between cheeks 13 and 14. Securing screws (not shown) can be inserted through mounting bores 17 for fastening the keeper B to the lock housing C. At one end of pocket 16 the cover 15 is bent over to form a support **15*a* for an abutment 18**.

Figure 2:
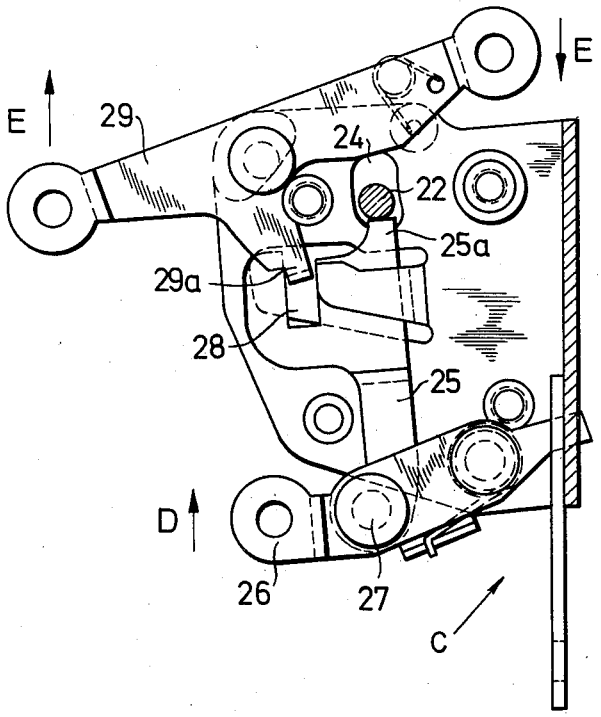
FIG. 2 is a view of a latch mechanism as seen from the rear, shown in unlocked position.
Figure 7:
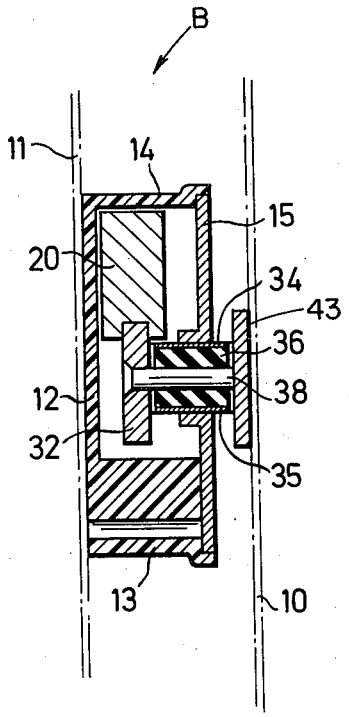
FIG. 7 is a vertical section of the keeper with the locking wedge inserted therein.

Upper cheek 14 accommodates a pivotable catch 20 which is fulcrumed on an axle 19 and is biased by a spring 21 in a locking direction. At its end remote from the axle 19, the catch 20 carries a linking pin 22 which passes through a slot 23 of the base plate 12 and also through a similar slot 24 in the lock housing C (see FIG. 2).

In the lock housing C the pin 22 co-operates with a detent 25 which is articulated at 27 to a release lever 26. The other end of the detent 25 is formed with a slot 28 to receive a projection **29*a* of a locking lever 29. With pin 22 abutting a lug 25*a* of detent 25, shown in FIG. 2, rotation of the release lever 26 in the direction of the arrow D entrains the catch 20** in an unlocking sense (counterclockwise in FIG. 5).

The locked state of the assembly is brought about by a clockwise swing of lever 29 as indicated by arrows E. The detent 25 then swings counterclockwise about its pivot point 27 so that the lug **25*a* is disaligned from pin 22. In case of an attempt to operate the release lever 26 under these circumstances, lug 25*a* simply moves past the pin 22**.

The locking wedge A is divided into three parts, namely a central body 33 of plastic material and two lateral plates 32, 43 (here shown to be of metal) flanking that body. Plate 43 is attached to the door post at its facing 10 and remains outside the keeper B whereas plate 32 enters the pocket 16 thereof. The latter plate has a smooth lower edge **32*a*, sliding along cheek 13, and an upper edge formed with indentations 32*b* (see FIG. 11) which are engageable by a tooth 20*a* of catch 20 upon incomplete or full closure of the door as is well known per se. Body 33, which is of lesser height than the flanking plates 32 and 43, fits into the guide channel 16' of keeper B between parallel edges 15***b* of its cover 15, this cover constituting an exposed sidewall of the keeper confronting the door post.

Figure 8:
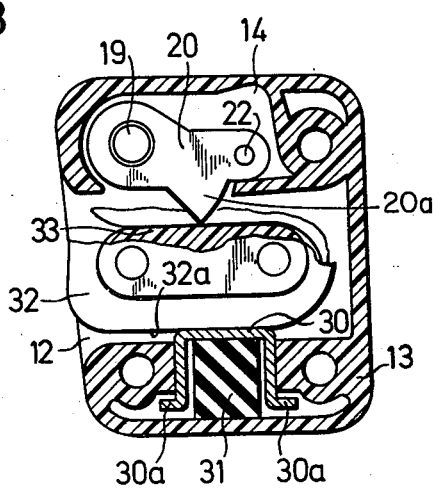
FIG. 8 is a section similar to that of FIG. 5, showing the keeper equipped with resilient play-equalization means.

As shown in FIG. 8, lower cheek 13 is centrally recessed to accommodate an elastic buffer 31 overlain by a metallic yoke 30 whose lower ends have lugs 30*a* holding it in position within that recess. Yoke 30 projects slightly above the upper surface of cheek 13 to bear upon the lower edge 32*a* of plate 32 for more positive guidance thereof in pocket 16.

In accordance with a feature of our present invention, and as particularly illustrated in FIGS. 7, 9, 10 and 12, the plastic body 33 of keeper B has a central cutout 37 receiving an elastic buffer 36 which is bracketed between an upper and a lower metallic yoke 34, 35 generally similar to yoke 30 of FIG. 8. Lugs 34*a*, 34*b* on the confronting ends of the legs of these yokes serve to retain them in the cutout 37. Through the intermediary of the two yokes, buffer 36 bears resiliently upon the edges 15*b* (FIGS. 3 and 4) of cover 15 which bound the guide channel 16', thereby equalizing whatever vertical play exists between these channel edges and the body 33. Buffer 36 is traversed by a horizontal bolt 38 interconnecting the plates 32 and 43.

FIGS. 13 – 15 show an alternative construction for the wedge body 33 which in this instance has a lateral flange 33' coextensive with and secured to the outer plate 43. The central body portion is cut away to form a space 40 around bolt 38 bounded at the bottom and at the top by a pair of tongues 39 integral with body 33, each tongue being connected with that body at one end only so as to be freely deflectable. These tongues bear elastically upon the channel edges 15*b* for the aforedescribed purpose of play equalization.

In FIGS. 16 and 17 we have shown a modification of the wedge construction of FIGS. 13 – 15 in which the space 40 is partly occupied by a cylindrical buffer 42 of elastic material centered on the connecting bolt 38 to form a resilient backstop for the tongues 39 whose free ends come to rest on its surface.

We claim:

1. A door lock assembly for an automotive vehicle provided with a post on the vehicular frame and a door with a post-confronting surface, comprising:

a locking wedge fixedly mounted on said post;

a keeper on said post-confronting surface of said door at the level of said wedge, said keeper having a pocket with an insertion end for said wedge and an exposed sidewall formed with a guide channel registering with said pocket, said guide channel being bounded by parallel upper and lower edges, said wedge including an indented plate receivable in said pocket, an outer plate secured to said post and an intermediate body of lesser height than said plates sandwiched therebetween for introduction into said channel;

catch means in said keeper engageable with said indented plate;

control means for said catch means in said door; and play-equalization means in said body elastically engaging said parallel upper and lower edges upon introduction of said body into said channel.

2. A door-lock assembly as defined in claim 1 wherein said play-equalization means comprises an elastic buffer, said body having a cutout receiving said buffer.

3. A door-lock assembly as defined in claim 2 wherein said wedge is provided with a connecting bolt spanning said plates, said buffer being traversed by said bolt.

4. A door-lock assembly as defined in claim 2 wherein said buffer is bracketed by upper and lower yokes extending into said cutout.

5. A door-lock assembly as defined in claim 4 wherein said yokes are provided within said cutout with lugs preventing detachment thereof from said body.

6. A door-lock assembly as defined in claim 2 wherein said body is integrally provided with upper and lower tongues resting upon said buffer for contact with said parallel edges.

7. A door-lock assembly as defined in claim 1 wherein said play-equalization means comprises a pair of elastic upper and lower tongues integral with said body and engageable with said parallel edges.

8. A door-lock assembly as defined in claim 7 wherein said body has a flange substantially coextensive with and secured to said outer plate.

* * * * *